US010808451B2

(12) United States Patent
Pannunzio

(10) Patent No.: US 10,808,451 B2
(45) Date of Patent: Oct. 20, 2020

(54) WINDOW FRAME AND ARCHITRAVE ASSEMBLY

(71) Applicant: ROPA SYSTEMS PTY LTD, Hampton, Victoria (AU)

(72) Inventor: Rocco Pannunzio, Oakleigh (AU)

(73) Assignee: ROPA SYSTEMS PTY LTD, Hampton, Victoria (AU)

( * ) Notice: Subject to any disclaimer, the term of this patent is extended or adjusted under 35 U.S.C. 154(b) by 141 days.

(21) Appl. No.: 15/545,921

(22) PCT Filed: Jan. 21, 2016

(86) PCT No.: PCT/AU2016/050032
§ 371 (c)(1),
(2) Date: Jul. 24, 2017

(87) PCT Pub. No.: WO2016/115604
PCT Pub. Date: Jul. 28, 2016

(65) Prior Publication Data

US 2018/0340363 A1 Nov. 29, 2018

(30) Foreign Application Priority Data

Jan. 22, 2015 (AU) ..... 2015900213

(51) Int. Cl.
*E06B 3/263* (2006.01)
*E06B 1/34* (2006.01)
(Continued)

(52) U.S. Cl.
CPC ..... *E06B 3/263* (2013.01); *E06B 1/342* (2013.01); *E06B 1/6023* (2013.01); *E06B 1/08* (2013.01); *E06B 1/36* (2013.01)

(58) Field of Classification Search
CPC ..... E06B 3/263; E06B 1/342; E06B 1/6023
See application file for complete search history.

(56) References Cited

U.S. PATENT DOCUMENTS 3,813,833 A * 6/1974 Dougherty ..... E06B 1/6023 52/214
4,224,772 A * 9/1980 Bene ..... E04B 2/702 52/213

(Continued)

FOREIGN PATENT DOCUMENTS

| | | |
|---|---|---|
| AU | 498569 B | 3/1979 |
| JP | H09105277 A | 4/1997 |
| JP | 2012012913 A | 1/2012 |

OTHER PUBLICATIONS

Australian Examination Report No. 1, dated Aug. 22, 2017 for corresponding Australian Application No. 2017101145.

(Continued)

*Primary Examiner* — Paola Agudelo
(74) *Attorney, Agent, or Firm* — David D. Brush; Westman, Champlin & Koehler, P.A.

(57) ABSTRACT

A window frame assembly for attachment to a window opening in a support structure, the assembly includes a first frame and a second frame that engage each other from opposite sides of the window opening, wherein the first frame includes a window and at least one abutment member adapted to be fixed to the support structure. The second frame includes at least one abutment member, such as a jamb, a head or a sill. The first frame includes a recess between the at least one abutment member and the window such that, upon engagement of the first frame and the second frame from opposite sides of the window opening, the at least one abutment member of the second frame is received by the recess of the first frame.

13 Claims, 5 Drawing Sheets

(51) Int. Cl.

| | |
|---|---|
| ***E06B 1/60*** | (2006.01) |
| *E06B 1/36* | (2006.01) |
| *E06B 1/08* | (2006.01) |

(56) References Cited

U.S. PATENT DOCUMENTS

| | | | | | |
|---|---|---|---|---|---|
| 4,811,533 | A * | 3/1989 | Wetsel | E06B 1/342 | 52/204.53 |
| 4,912,899 | A * | 4/1990 | Plasker | E04B 9/008 | 52/241 |
| 5,303,529 | A * | 4/1994 | Guardia | A47H 1/00 | 52/309.16 |
| 5,555,684 | A * | 9/1996 | Galowitz | E06B 1/342 | 52/204.5 |
| 5,941,033 | A * | 8/1999 | Adams | E06B 1/30 | 52/211 |
| 6,389,763 | B1 * | 5/2002 | Clauss | E06B 1/342 | 49/504 |
| 2003/0226321 | A1 * | 12/2003 | Engebretson | E06B 1/345 | 52/204.54 |
| 2005/0193654 | A1 * | 9/2005 | Primozich | E06B 1/342 | 52/204.5 |
| 2008/0072507 | A1 * | 3/2008 | Chuang | E06B 1/342 | 52/204.5 |
| 2008/0202034 | A1 * | 8/2008 | Campbell | E05B 15/0205 | 49/504 |
| 2009/0044466 | A1 * | 2/2009 | Andres | E04F 19/02 | 52/204.53 |
| 2009/0193728 | A1 | 8/2009 | Butler et al. | | |
| 2011/0296777 | A1 * | 12/2011 | Matta | E06B 1/342 | 52/208 |

OTHER PUBLICATIONS

International Search Report dated Feb. 15, 2016, for corresponding International Patent Application PCT/AU2016/050032 filed on Jan. 21 2016.

Written Opinion of the International Searching Authority dated Feb. 15, 2016, for corresponding International Patent Application PCT/AU2016/050032 filed on Jan. 21, 2016.

* cited by examiner

WINDOW FRAME AND ARCHITRAVE ASSEMBLY

The present application is a Section 371 National Stage Application of International Application No. PCT/AU2016/050032, filed Jan. 21, 2016, which is incorporated by reference in its entirety and published as WO 2016/115604 A1 on Jul. 28, 2016, in English.

FIELD

The present invention relates generally to an assembly enabling the fixing of windows and the like to a support structure such as a wall and more particularly, relates to a window frame assembly comprising complementary profiled members that inter-engage from opposite sides of a window opening to form a window frame and architrave assembly.

Bibliographic details of certain publications numerically referred to in this specification are collected at the end of the description.

BACKGROUND

There are many different forms of window frames presently used in the construction industry, including those made from timber and which are profiled to suit the requirements of particular window sizes and types. Timber window frames have been used for many years in building structures, particularly in domestic dwellings. With the advent of high-rise buildings and home units, there has been an increase in the use of window frames manufactured from metal and built into the structural support (e.g., wall) to which they are attached. These metal window frames are typically be built in at the time the walls are constructed and are primarily suited for use with masonry or concrete walls and, as such, have ties fitted to the back of the window jamb(s) which are anchored by the wall structure.

A window typically comprises one or more glass panes fixed in place by an assembly of stiles and rails; the combination of which is often called a sash. For a typical installation within an opening of a structural support, such as a wall, a window frame is constructed to which the window will be affixed. A window frame will typically comprise two substantially vertical side jambs (the main vertical parts forming the sides of the window frame), a head jamb (main horizontal part forming the top of the window frame) and a sill (the main horizontal part forming the bottom of the window frame).

Since there are significant labour costs associated with building construction, there is an ever present need to minimize handling and the time taken to complete a building project. To this end, fixtures such as window frame assemblies are typically manufactured off-site to a pre-determined size, often with a window (i.e., sash) affixed thereto, and subsequently transported to a construction site for installation. Installing window frames at the tail end of construction can also minimize the possibility of damage.

During installation, the window frame assembly is positioned into a predetermined opening of a structural support. The jambs, head and sill of the window frame are then secured to the structural support by screws or other fastening means.

Once the window frame is secured to the structural support, there are several additional steps that must be taken to hide any unsightly finishes. These include the use of construction putty or other suitable filler to cover the screws used to affix the jambs, head and/or sill to the structural support, sanding back the construction putty or filler and subsequently painting over the jambs, head and sill to achieve the desired finish.

The internal periphery of the window frame can also be unsightly, particularly at the juncture of the window frame and internal wall cladding. This is typically alleviated by surrounding the internal periphery of the window frame with an architrave, or a style of molding that covers any unsightly joins or gaps between the window frame and wall.

Whilst existing window frames and window frame assemblies have been used for many years, the time taken to install them and make the subsequent modifications necessary to achieve the desired aesthetic finish, as outlined above, has meant that significant labour costs are added to a building project. Attention has therefore been directed to an alternative window frame assembly that minimizes labour and subsequent building costs.

Disclosed herein is an alternative window frame assembly, and a method of erection thereof, which, upon installation, reduces the number of subsequent modifications required to provide the desired finish.

SUMMARY

Disclosed herein is a window frame assembly for attachment to a window opening in a support structure, the assembly comprising a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure;

wherein the second frame is adapted to fit in and about the window opening from an internal side of the opening, wherein the second frame comprises at least one abutment member selected from the group consisting of a jamb, a head and a sill; and wherein the first frame comprises a recess between the at least one abutment member and the window such that, upon engagement of the first frame and the second frame from opposite sides of the window opening, the at least one abutment member of the second frame is received by the recess of the first frame.

There is also disclosed herein a method for fixing a window frame to a window opening of a support structure, the method comprising:

(i) placing a first frame into the window opening from an external side of the opening, wherein the first frame comprises a window, at least one abutment member for engagement with the support structure and a recess between the window and the at least one abutment member;

(ii) fixing the at least one abutment member of the first frame to the support structure to thereby effect a fixed engagement thereto; and (iii) bringing a second frame into engagement with the fixed first frame from an internal and opposite side of the window opening to the first frame, wherein the second frame comprises at least one abutment member selected from the group consisting of a jamb, a head and a sill, wherein the at least one abutment member of the second frame is received by the recess between the window and the at least one abutment member of the first frame.

DETAILED DESCRIPTION OF THE INVENTION

Unless defined otherwise, all technical and scientific terms used herein have the same meaning as commonly understood by those of ordinary skill in the art to which the invention belongs. Although any methods and materials similar or equivalent to those described herein can be used in the practice or testing of the present invention, preferred methods and materials are described. For the purposes of the present invention, the following terms are defined below.

The terms "a" and "an" are used herein to refer to one or to more than one (i.e. to at least one) of the grammatical object of the article. By way of example, "a jamb" means one jamb or more than one element, unless otherwise stated herein.

Throughout this specification, unless the context requires otherwise, the words "comprise", "comprises" and "comprising" will be understood to imply the inclusion of a stated step or element or group of steps or elements but not the exclusion of any other step or element or group of steps or elements. Thus, use of the term "comprising" and the like indicates that the listed elements are required or mandatory, but that other elements are optional and may or may not be present.

As discussed elsewhere herein, due to the significant labour costs associated with building construction, there is an ever present need to minimize handling and the time taken to complete a building project. To this end, windows and window frames, also referred to as a "window assembly", are often manufactured to pre-determined specifications before installation, which typically occurs at the tail end of construction with a view to minimising the risk of damage. During installation, a window frame assembly is positioned into a predetermined opening of a structural support. The jambs, head and sill of the window frame are then fixed to the structural support by screws or other fastening means. Once the window frame assembly is secured to the structural support, there are several additional steps that must be taken to hide any unsightly finishes. These include the use of construction putty or other suitable filler to cover the screws used to affix the jambs, head and/or sill to the structural support, sanding back the construction putty or filler and subsequently painting over surface of the jambs, head and sill to achieve the desired finish. The internal periphery of the window frame can also be unsightly, such as at the juncture of the window frame and internal wall cladding. This is typically alleviated by surrounding the internal periphery of the window frame with an architrave, or a style of molding that covers any unsightly joins or gaps between the window frame and wall. Whilst such steps are necessary to achieve the desired finish, they are labour intensive and add to the building costs. The present inventor solves or at least partly alleviate these problems by providing a window frame assembly for attachment to a window opening in a support structure, the assembly comprising a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure;

wherein the second frame is adapted to fit in and about the window opening from an internal side of the opening, wherein the second frame comprises at least one abutment member selected from the group consisting of a jamb, a head and a sill; and wherein the first frame comprises a recess between the at least one abutment member and the window such that, upon engagement of the first frame and the second frame from opposite sides of the window opening, the at least one abutment member of the second frame is received by the recess of the first frame.

When the second frame is installed in and about the window opening from an internal side of the opening, the at least abutment member of the second frame covers the at least one abutment member of the first frame, hiding any unsightly finishes, such as screws or other means used to fix the first frame to the support structure. This simplifies the installation and post-installation processes, because it minimizes the additional steps that would otherwise be required to hide such unsightly finishes, as required for existing window frame assemblies.

The first frame may comprise at least one, at least two, at least three or at least four abutment members; that is, members that align with a structural support to which it can be affixed. Persons skilled in the art will appreciate, however, that the stability of the window frame assembly can be increased by have a greater number of abutment members affixed to the structural support. Thus, in an embodiment, the first frame comprises at least two abutment members. In another embodiment, the first frame comprises at least three abutment members. In yet another embodiment, the first frame comprises at least four abutment members. For example, where the window frame comprises four sides (e.g., a square or rectangular window frame), all four sides may comprise an abutment member. Where the window frame has a greater number of sides (e.g., a hexagonal, heptagonal, octagonal, etc.), each side may comprise an abutment member for greater stability when the first frame is affixed to the structural support. It will be appreciated, however, that not all abutment members need to be affixed to the structural support, as long as enough abutment members are affixed thereto so as to effect a secure and stable engagement to the structural support, as required, for example, by building laws and regulations.

The first window frame can be affixed to the structural support by any means know to persons skilled in the art. Illustrative examples include the use of nails, screws and the like, which can be passed through the abutment member(s) of the first frame and into the structural support, such as a structural beam, post, column or pillar.

In an embodiment, the at least one abutment member of the first frame is adapted to be fixed to the support structure by at least one fixing screw which attaches to said support structure through the at least one abutment via a profiled recess. This allows the head of the fixing screw to be positioned within the profiled recess, minimizing the risk that the abutment member(s) of the second frame will catch on an otherwise exposed part of the fixing screw.

The second window frame will typically be fixed to the support structure and/or first frame to thereby effect a fixed engagement thereto. This can be accomplished by any means know to persons skilled in the art. Illustrative examples include the use of nails, screws and the like, which can be passed through the architrave and/or abutment member(s) of the second frame and into the support structure and/or first frame. Persons skilled in the art will appreciate that whatever means is used to affix the second frame to the support structure and/or first frame preferably minimizes the labour and time required to hide any unsightly finish resulting therefrom. Thus, in some embodiments, the second frame is fixed to the support structure and/or first frame by using nails of a certain (minimal) gauge that can effect a secure engagement of the second frame to the structural support, yet be easily covered and/or painted over.

In some embodiments, the second frame is fixed to the support structure and/or first frame via the architrave. Thus, in an embodiment, the architrave further comprises an engagement means for fixing the second frame to the support structure.

As discussed elsewhere herein, each abutment member of the second frame is typically designed to cover at least part of an abutment member of the first frame, more preferably, that portion of the first frame abutment member comprising an otherwise exposed engagement means, such as a nail or screw. In some embodiments, however, each abutment member of the second frame will cover the entire abutment member of the first frame, such that no portion of the first frame abutment member is visible upon engagement of the second frame to the first frame, as herein described. In an embodiment, the second frame comprises at least two abutment members selected from the group consisting of a side jamb, a head jamb and a sill. In another embodiment, the second frame comprises at least three abutment members selected from the group consisting of a first side jamb, a second side jamb, a head jamb and a sill. In yet another embodiment, the second frame comprises, as abutment members, a first side jamb, a second side jamb, a head jamb and a sill. For instance, where the window frame comprises four sides (e.g., a square or rectangular window frame), the second frame may comprise four abutment members made up of two side jambs, a head jamb and a sill, such that all four abutment members of the first frame will be covered, partly or in full, by the two side jambs, the head jamb and the sill of the second frame. Similarly, where the window frame has six sides (i.e., a hexagonal), the second frame may comprise six abutment members comprising at least one side jamb, at least one head jamb and at least one sill, such that all six abutment members of the first frame will be covered, partly or in full, by the abutment members of the second frame.

It will be understood that the architrave may or may not be present on a component of the window frame assembly when the assembly is installed. Where the architrave is already present, the invention provides a window frame and architrave assembly for attachment to a window opening in a support structure, the assembly comprising a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure;

wherein the second frame is adapted to fit in and about the window opening from an internal side of the opening, wherein the second frame comprises an architrave and at least one abutment member selected from the group consisting of a jamb, a head and a sill; and wherein the first frame comprises a recess between the at least one abutment member and the window such that, upon engagement of the first frame and the second frame from opposite sides of the window opening, the at least one abutment member of the second frame is received by the recess of the first frame.

Where the architrave is not present on a component of the window frame assembly, the architrave may be fixed thereto subsequent to installation. This allows for the architrave to be selected or sourced well after the time of window installation and subsequently fixed to the installed window. In other embodiments the architrave is already attached to a component of the window assembly, there being no requirement to fix an architrave after installation. These alternative forms of the invention apply to both the window assembly per se, as well as a method for installing the window assembly.

Also disclosed herein is a method for fixing a window frame assembly to a window opening of a support structure, the method comprising:

(i) placing a first frame into the window opening from an external side of the opening, wherein the first frame comprises a window, at least one abutment member for engagement with the support structure and a recess between the window and the at least one abutment member;

(ii) fixing the at least one abutment member of the first frame to the support structure to thereby effect a fixed engagement thereto; and (iii) bringing a second frame into engagement with the fixed first frame from an internal and opposite side of the window opening to the first frame, wherein the second frame comprises at least one abutment member selected from the group consisting of a jamb, a head and a sill, wherein the at least one abutment member of the second frame is received by the recess between the window and the at least one abutment member of the first frame.

In one embodiment, the method comprises step (iv) fixing an architrave to the support structure and/or to the first frame. As discussed above, fixing the architrave may be undertaken as a separate task after installation of the window.

In one embodiment of the method, an architrave is already present such that the method comprises:

(i) placing a first frame into the window opening from an external side of the opening, wherein the first frame comprises a window, at least one abutment member for engagement with the support structure and a recess between the window and the at least one abutment member;

(ii) fixing the at least one abutment member of the first frame to the support structure to thereby effect a fixed engagement thereto;

(iii) bringing a second frame into engagement with the fixed first frame from an internal and opposite side of the window opening to the first frame, wherein the second frame comprises an architrave and at least one abutment member selected from the group consisting of a jamb, a head and a sill, wherein the at least one abutment member of the second frame is received by the recess between the window and the at least one abutment member of the first frame; and (iv) fixing the architrave to the support structure and/or to the first frame to thereby effect a fixed engagement thereto.

The present invention will now be described in more detail according to each aspect and with reference to a preferred but non limiting embodiment wherein.

Figure 3:
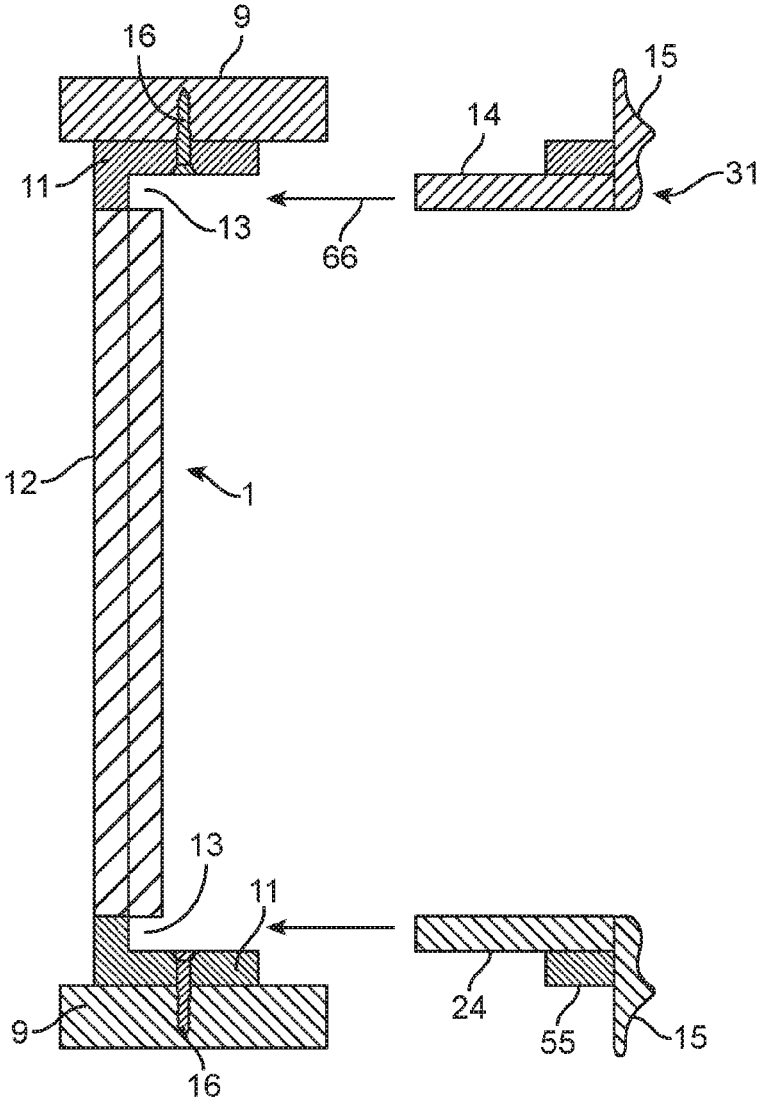
FIG. 3 shows an exploded cross section through the window frame and architrave assembly according to an embodiment of the present invention, in two parts, comprising the first frame (left) and the second frame (rights)
Figure 5:
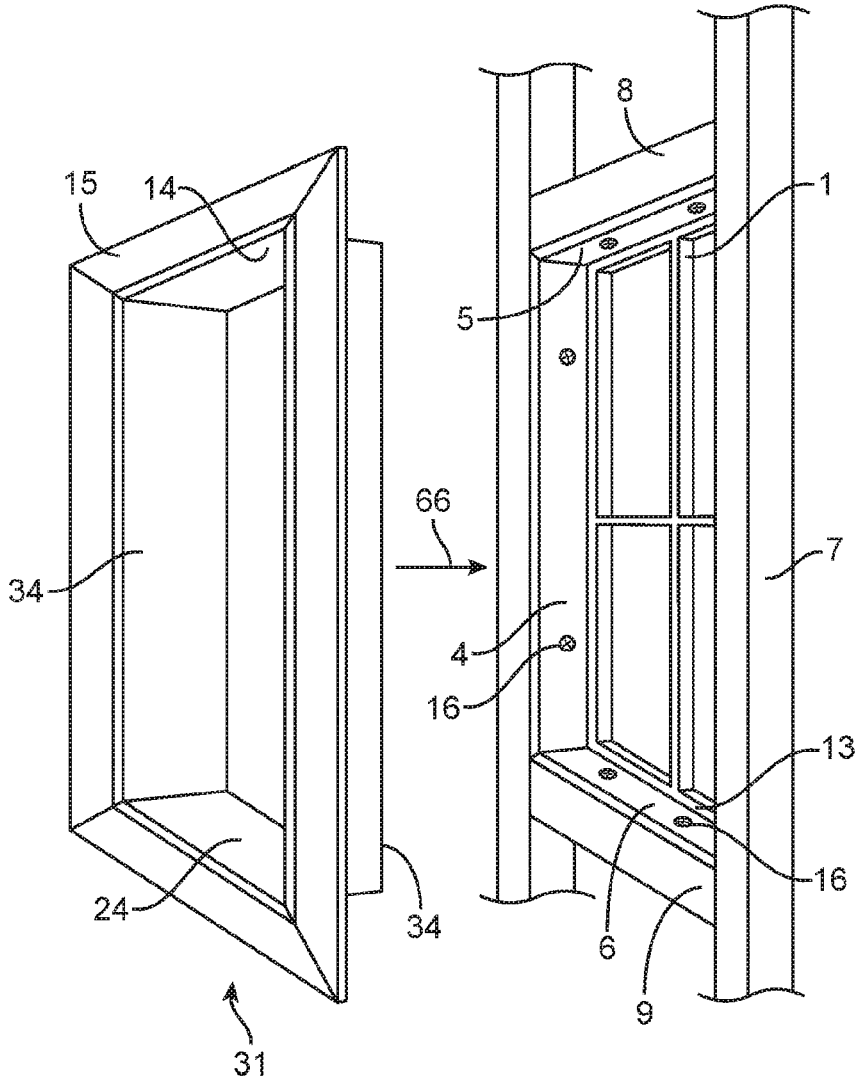

FIG. 5: shows a perspective view of the arrangement of FIG. 3.

Figure 1:
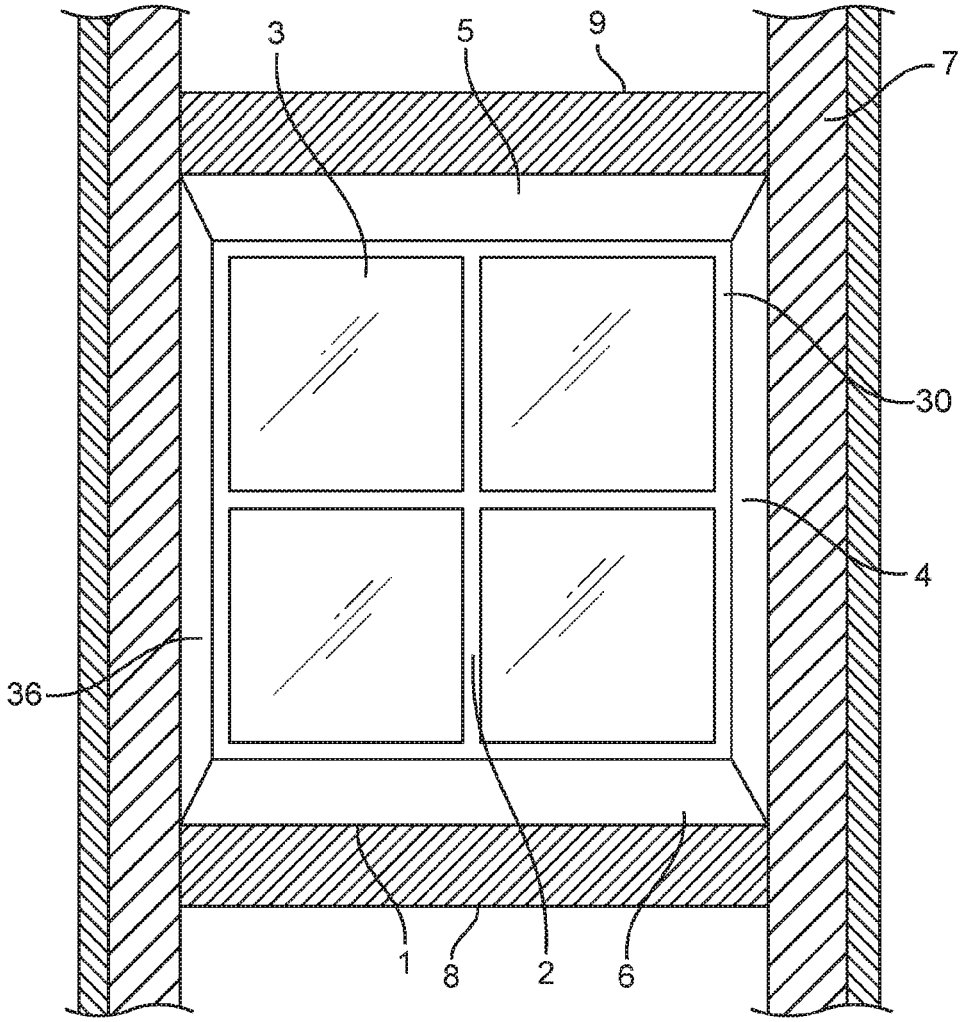
FIG. 1 shows a front perspective of a first window frame according to an embodiment of the present invention fitted in situ to a wall structure.

Referring to FIG. 1, there is shown a front perspective of the first window frame (1) comprising a window (30) made up of four panes of glass (3) fixed in place by an assembly of stiles and rails (2), the combination of which is called a sash, and four abutment members (4, 5, 6 and 36). The first window frame is shown affixed to a structural supports comprising beams (8, 9) and posts (7). The structural posts (7) and beams (8, 9) effectively sandwich the first frame there between. The abutment members (4, 5, 6 and 36) are engaged and affixed to one or more of the structural supports (7, 8, 9) by using suitable fixing means, such as screws.

Figure 2:
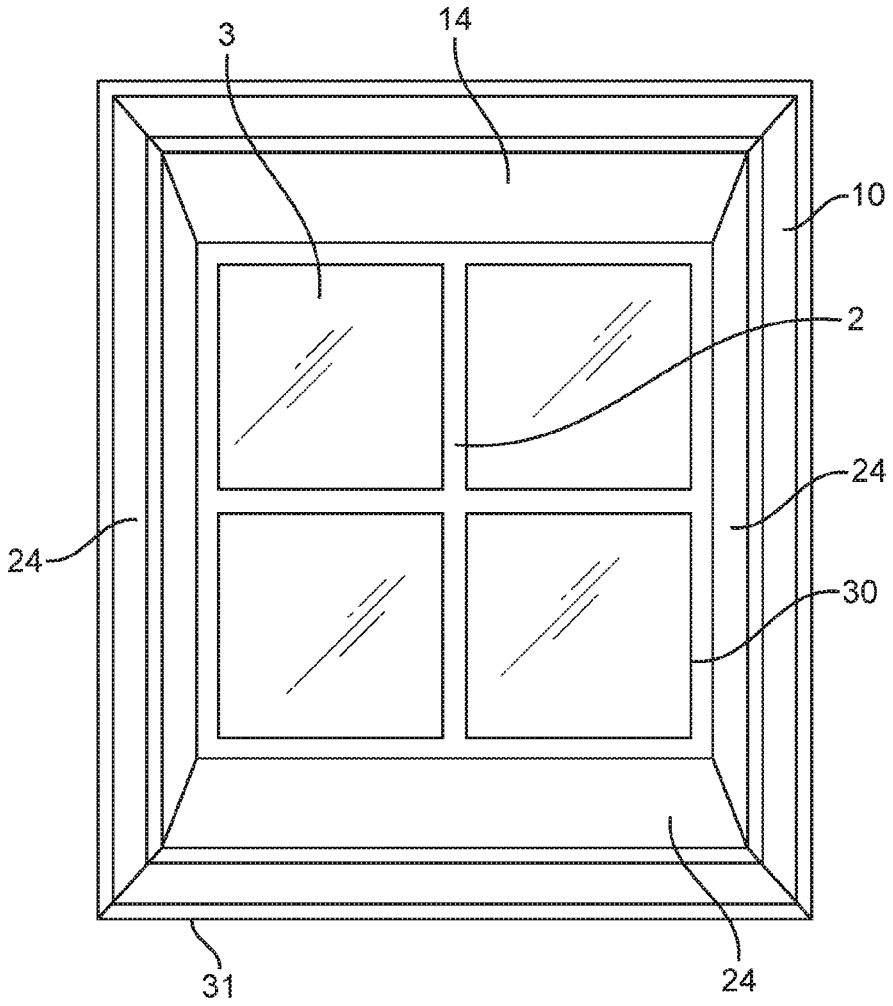
FIG. 2 shows a front perspective of a second window frame according to an embodiment of the present invention fitted in situ to a wall structure.

Referring to FIG. 2, there is shown a front perspective of the second window frame according to an embodiment of the present invention, wherein second frame (31) is engaged with the first frame in opposing relationship, fitted to a window opening of the structural support. The second frame comprises an architrave (10) framing the window (30) and four abutment members: two side jambs (24), a head jamb (14) and a sill (24).

FIG. 3 is a cross sectional view taken through part of a support structure (wall) to which the first window frame (1) (left) is fitted, wherein two abutment members of the first frame (11) are engaged with two beams (9) of the structural support and fixed thereto by screws (16). Also shown in FIG. 3 is the recess (13) between the window (12) and the abutment members (11) of the first window frame (1). The representation also shows a cross sectional view through the second window frame of the assembly (31) (right) about to be brought into contact with the first frame (1) from an internal and opposite side of the window opening to the first window frame (1), as shown by the directional arrow. The second frame (31), comprising at least two abutment members (14, 24) is brought into engagement with the fixed first frame (1) from an internal and opposite side of the window opening to the first frame, wherein the abutment members (14, 24) are to be received by the recesses (13) of the first frame (1). Also shown is a cross sectional view of the architrave (15).

Figure 4:
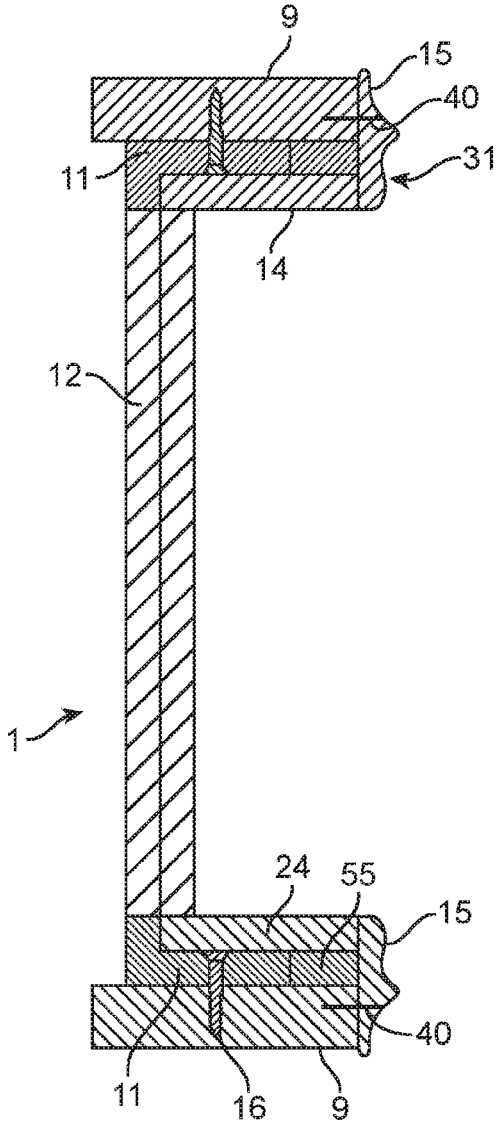
FIG. 4 shows the arrangement of FIG. 3 with profiled members (i.e., the first and second frames) engaged together.

FIG. 4 is a cross sectional view taken through part of a support structure (wall) to which the first window frame (1) is fitted, wherein two abutment members of the first frame (11) are engaged with two beams (9) of the structural support and fixed thereto by screws (16). The representation also shows a cross sectional view through the second window frame of the assembly (31) that has been fitted into the window opening from an internal and opposite side of the opening to the first window frame (1), as shown by the directional arrow in FIG. 3. The second frame (31) comprises at least two abutment members (14, 24) that have been brought into contact with the fixed first frame (1) from an internal and opposite side of the window opening to the first frame, such that the abutment members (14, 24) have been received by the recesses (13) of the first frame (1), as shown in FIG. 3. Also shown is a cross sectional view of the architrave (15), which has been fixed to the structural supports (9) by nails (40), thus securing the second window frame in place. As shown in FIG. 4, the abutment members of the second frame (14, 24) cover the otherwise exposed screws (16) used to affix the abutment members (5) of the first frame (1) to the structural supports (9).

FIG. 5 is a perspective view of the first window frame (1) (right) and the second window frame (31) (left) according to an embodiment of the assembly disclosed herein, wherein second frame (31) is about to be inserted into the window opening from an internal and opposite side of the opening to the first window frame (1), as shown by the directional arrow. The first window frame (1) is shown affixed to a structural supports comprising beams (8, 9) and posts (7). The structural posts (7) and beams (8, 9) effectively sandwich the first frame there between. The abutment members (4, 5, 6) are engaged and affixed to the structural supports (7, 8, 9) by using suitable fixing means, such as screws (16). The perspective view of the second window frame (31) shows the architrave (15) and four abutment members: two side jambs (34), a head jamb (14) and a sill (24).

When the second window frame (31) is brought into contact with the first frame (1) from an internal and opposite side of the window opening to the first window frame (1), as shown by the directional arrow, the abutment members (34, 14, 24) are received by the recesses (13) of the first frame, covering the first frame abutment members (4, 5, 6) and the screws (16).

The present invention provides an alternative whereby the carpenter or window fitter can insert the window frame assembly to the window opening of a structural support such as a wall, even after the wall cladding has been painted and other work completed, as there is very little trauma to the structure in affixing the window frame assembly according to the present invention. The window frame assembly is particularly useful with walls having a normal width of about 90 mm, but it will be appreciated that the assembly can be applied to walls of any desired width. Also the length of abutment members of the first and second frames can be adjusted to accommodate different wall thicknesses. It will also be understood that the window frame assembly described herein is not to be construed as confined to buildings, but could equally be used in other applications such as in furniture construction and modular partitioning construction in both internal and external applications. The present invention also provides a finished architrave so that the completed window surround including jamb, head, sill and architrave is effected as soon as the first and second window frames are installed.

It will be recognised by persons skilled in the art that numerous variations and modifications can be made to the overall invention without departing from the spirit and scope of the invention as broadly described herein.

The reference in this specification to any prior publication (or information derived from it), or to any matter which is known, is not, and should not be taken as an acknowledgement or admission or any form of suggestion that the prior publication (or information derived from it) or known matter forms part of the common general knowledge in the field of endeavour to which this specification relates.

The invention claimed is:

1. A window frame assembly for attachment to a window opening in a support structure, the assembly comprising:

a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure using fixing means;

wherein the second frame is adapted to fit in and about the window opening from an internal side of the opening, wherein the second frame comprises at least one abutment member selected from the group consisting of a jamb, a head and a sill; and wherein the first frame comprises a recess between the at least one abutment member and the window and in a region of the first frame that is directly beneath, above or lateral to the at least one abutment member such that, upon engagement of the first frame and the second frame from opposite sides of the window opening, the at least one abutment member of the second frame is received by the recess of the first frame and the fixing means used to fix the at least one abutment member of the first frame to the support structure is concealed by the at least one abutment member of the second frame.

2. The assembly of claim 1, wherein the second frame comprises an architrave.

3. The assembly of claim 2, wherein the architrave comprises an engagement means for fixing the second frame to a support structure.

4. The assembly of claim 1, wherein the second frame comprises, as abutment members, a first side jamb, a second side jamb, a head jamb and a sill.

5. The assembly of claim 1, wherein the first frame comprises at least two abutment members.

6. The assembly of claim 1, wherein the first frame comprises at least three abutment members.

7. The assembly of claim 1, wherein the first frame comprises at least four abutment members.

8. The assembly of claim 1, wherein the at least one abutment member of the first frame is adapted to be fixed to the support structure by at least one fixing screw which attaches to said support structure through the at least one abutment via a profiled recess.

9. A method for fixing a window jamb to a window opening of a support structure, the method comprising:

(i) placing a first frame into the window opening from an external side of the opening, the first frame fitting in and about the window opening, wherein the first frame comprises a window, at least one abutment member for engagement with the support structure and a recess between the window and the at least one abutment member;

(ii) from an internal and opposite side of the window opening fixing the at least one abutment member of the first frame to the support structure using fixing means to thereby effect a fixed engagement thereto, the fixing means being visible from the internal and opposite side of the window; and (iii) bringing a second frame into engagement with the fixed first frame from an internal and opposite side of the window opening to the first frame, the second frame fitting in and about the window opening, wherein the second frame comprises at least one abutment member selected from the group consisting of a jamb, a head and a sill, wherein the at least one abutment member of the second frame is received by the recess between the window and the at least one abutment member of the first frame, and the fixing means used to fix the at least one abutment member of the first frame to the support structure then becoming concealed by the at least one abutment member of the second frame.

10. The method of claim 9 comprising:

(iv) fixing an architrave to the support structure and/or to the first frame.

11. The method of claim 9 wherein the second frame comprises an architrave, and wherein the method comprises fixing the architrave to the support structure and/or to the first frame to thereby effect a fixed engagement thereto.

12. A window frame assembly for attachment to a window opening in a support structure, the assembly comprising:

a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure using fixing means;

wherein the second frame is adapted to fit in and about the window opening from an internal side of the opening, wherein the second frame comprises at least one abutment member selected from the group consisting of a jamb, a head and a sill; and wherein the first frame comprises a recess between the at least one abutment member and the window such that, upon engagement of the first frame and the second frame from opposite sides of the window opening, the at least one abutment member of the second frame is received by the recess of the first frame and the fixing means used to fix the at least one abutment member of the first frame to the support structure is concealed by the at least one abutment member of the second frame.

13. A window frame assembly for attachment to a window opening in a support structure, the assembly comprising:

a first frame and a second frame that engage each other from opposite sides of the window opening;

wherein the first frame is adapted to fit in and about the window opening from an external side of the opening, wherein the first frame comprises a window and at least one abutment member, wherein the at least one abutment member is adapted to be fixed to the support structure using fixing means;

wherein the second frame is adapted to fit in and about the window opening from an internal side of the opening, wherein the second frame comprises at least one abutment member selected from the group consisting of a jamb, a head and a sill; and wherein the first frame comprises a recess between the at least one abutment member and the window such that, upon engagement of the first frame and the second frame from opposite sides of the window opening, the at least one abutment member of the second frame is received by the recess of the first frame and the fixing means used to fix the at least one abutment member of the first frame to the support structure is concealed by the at least one abutment member of the second frame.

* * * * *